United States Patent [19]

Hässler et al.

[11] 4,222,167

[45] Sep. 16, 1980

[54] METHOD OF MANUFACTURING A CONTACT BRIDGE

[75] Inventors: Heinrich Hässler, Wendelstein; Joachim Grosse, Erlangen; Gert Fischer; Joachim Hannich, both of Amberg, all of Fed. Rep. of Germany

[73] Assignee: Siemens Aktiengesellschaft, Berlin and Munich, Fed. Rep. of Germany

[21] Appl. No.: 899,961

[22] Filed: Apr. 25, 1978

[51] Int. Cl.[3] ..... H01R 43/00

[52] U.S. Cl. ..... 29/875; 29/876

[58] Field of Search ..... 29/630 R, 630 C

[56] References Cited

U.S. PATENT DOCUMENTS

| | | | |
|---|---|---|---|
| 1,181,741 | 5/1916 | Coolidge | 29/630 C X |
| 1,181,742 | 5/1916 | Coolidge | 29/630 C X |
| 2,365,249 | 12/1944 | Comstock | 29/630 C |
| 2,706,759 | 4/1955 | Williamson | 29/630 C X |
| 2,723,444 | 11/1955 | Harvey | 29/630 C |
| 3,226,517 | 12/1965 | Schreiner | 29/630 C X |
| 3,391,444 | 7/1968 | Haller | 29/630 C |
| 3,821,848 | 7/1974 | Backstrom | 29/630 C |
| 3,863,337 | 2/1975 | Schreiner et al. | 29/630 C |
| 3,864,827 | 2/1975 | Schreiner et al. | 29/630 C |

FOREIGN PATENT DOCUMENTS

| | | | |
|---|---|---|---|
| 749390 | 5/1956 | United Kingdom | 29/630 |

*Primary Examiner*—Daniel C. Crane
*Assistant Examiner*—C. J. Arbes
*Attorney, Agent, or Firm*—Kenyon & Kenyon

[57] ABSTRACT

A method of manufacturing a contact bridge for an electric switching apparatus which contact bridge includes an electrically highly conductive overlay and a concave-shaped support layer. The method comprises the steps of pressing a powder blank comprising two layers of metallic material, one of which comprises iron for the support layer and the other of which comprises copper for the overlay; sintering the blank in a protective gas; sizing the blank; further sintering the blank in a protective gas; further pressing the blank by reverse-flow cup extrusion; and applying an electrical contact to the overlay. Alternatively, the powder blank may comprise a layer of copper-zirconium and silver-metal oxide, the latter for an electrical contact layer. In this embodiment, the contact bridge is formed with the electrical contact in one step and there is no need to apply a contact to the bridge after the pressing by reverse-flow cup extrusion.

2 Claims, 2 Drawing Figures

METHOD OF MANUFACTURING A CONTACT BRIDGE

BACKGROUND OF THE INVENTION

1. Field of the Invention

The invention relates to a method of manufacturing a contact bridge for an electric switching apparatus which contact bridge has an electrically highly conductive overlay and a concave-shaped support member.

2. Description of the Prior Art

It is desirable to make contact bridges of the foregoing type with a low mass. However, such contact bridges must have relatively great stiffness; in addition, high conductivity in the direction of the current flow is required.

Such contact bridges have, therefore, been fabricated as stamped and bent iron parts. See, for example, U.S. Pat. No. 3,818,170. A copper overlay and the electrical contacts proper are soldered onto this type of contact bridge, i.e., a bent iron contact bridge. The disadvantage of such contact bridges is that their manufacturing costs are relatively high.

SUMMARY OF THE INVENTION

It is therefore an object of the present invention to provide a method of manufacturing a contact bridge for an electric switching apparatus, which contact bridge includes an electrically highly conductive overlay and a concave-shape support layer, which is simpler than heretofore known methods and which enables the production of a contact bridge which has a small mass and great stiffness and which exhibits fewer solder joints and provides better conductivity in the region of the current flow and improved production control.

These and other objects of the invention are achieved in a method of manufacturing a contact bridge for an electric switching apparatus, which contact bridge includes an electrically highly conductive overlay and a concave-shaped support layer. The method comprises the steps of pressing a powder blank comprising two layers of metallic material, one of the layers comprising iron and one of the layers comprising copper, the iron layer comprising the support layer and the copper layer comprising the overlay; sintering the blank in a protective gas; sizing the blank; further sintering the blank in a protective gas; further pressing the blank by reverse-flow cup extrusion; and applying an electrical contact to the overlay.

Cold deformation of sintered iron by reverse-flow cup extrusion is known in the art. See Industrieanzeiger 93, Vol. No. 101, Dec. 3, 1971, p. 2563. This method is not, however, by itself successful, since in the known cold deformation methods, in which single-layer parts are used exclusively, an optimum sintering temperature can be chosen (0.8 to 0.9 $T_m$, $T_m$ being the melting temperature in °K.) so that the residual porosity is less than 15%. If a two-layer sintered member is used, for example, a member comprising copper and iron, the sintering conditions are less favorable since the melting point of the lower-melting metal, copper in this case, must not be exceeded. At the same time, it is also impossible to use the optimal pressure of 500 to 600 MN $m^{-2}$ ($10^6$ Newton/$m^2$) for densifying the iron powder, since the copper layer is then overdensified. Excessive plastic deformation of the copper metal grains results first in seizing of the deformation tool and second in heavy bubble formation due to occluded gases.

For these reasons, the pressure which can be used in such methods is limited to a range between 200 and 400 MN $m^{-2}$. This, together with the sintering temperature of about 1000° C., which is too low for flowable iron powder, results in a residual porosity of about 30%. With such a high residual porosity, it is impossible to achieve cold deformation without cracks by reverse-flow cup extrusion alone.

In the case of single-layer sintered bodies, it is also known in the art to manufacture sintered steels for dynamically highly stressed parts in five process steps, namely, pressing, sintering, after-pressing, sintering, and sizing. See Reprint from "Maschinenmarkt", Vogelverlag, Vol. 74, Nos. 11, 19, 29, 1969, "Gears of Sintered Materials", Table 1, last column, "Sintered Steels for Dynamically Highly Stressed Parts". The problems of two-layer sintered bodies, however, do not arise in this case since the electric conductivity is not important.

The preferred sintering temperature in the method of the invention is 1000° C. if copper and iron are used as the layers for the powder blank. When pressing is effected at a pressure of about 200 MN $m^{-2}$, sizing at 800 MN $m^{-2}$, and reverse-flow cup extrusion at 2000 MN $m^{-2}$, optimal properties are obtained for the contact bridge. A pressure of 2000 MN $m^{-2}$ is required to fabricate end faces with relatively sharp corners. This pressure can be reduced, however, if more rounded corners can be tolerated.

If the electrical contacts are also to be joined to the contact bridge in one operation, the two-layer powder blank preferably comprises copper-zirconium (CuZr) and silver-metal oxide material as the contact material. Because of the eutectic formed between the copper and silver a sintering temperature of less than 780° C. is used. The zirconium is added to the overlay in this case to increase the strength of the bridge if copper is used.

A contact bridge fabricated in accordance with the foregoing method of the invention has a small mass and great stiffness as well as high conductivity in the region of the current flow and enables increased production control.

These and other novel features and advantages of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
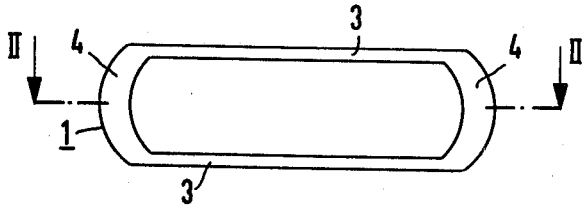
FIG. 1 is a bottom plan view of a contact bridge fabricated in accordance with the method of the invention.
Figure 2:
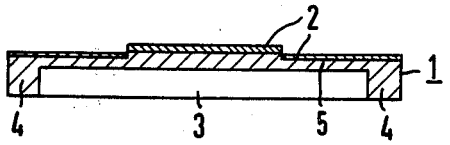
FIG. 2 is a longitudinal cross-sectional view of the contact bridge taken along section II—II of FIG. 1.

Referring now to the drawings, there is shown a contact bridge including a support layer 1 and a copper overlay 2. As can be seen from the drawing, the contact bridge has elongated rims 3 which have relatively thin side walls. Rims 3 are thicker at the end faces 4 of the contact bridge by a ratio of 5:2 with respect to the side walls and function as burn-off material for the arcs generated. The end faces of the rims must have a rectangular-shaped cross-section to prevent a damper spring (not shown) from sliding out of the tray formed by the bottom of the contact bridge. To avoid the contact bridge from being unnecessarily heavy, the thickness of the bottom 5 of the contact bridge support layer 1 is made relatively small. There are, however, limits to this due to the deformation mechanism. The contact overlays soldered to the copper overlay 2 are not shown in the drawing.

The process of the invention may be illustrated by the following example:

Iron and copper were used as the starting powder. A lower molding die of a pressing apparatus having a center region including a depression was filled with copper powder. Pressing produced a copper layer which was thicker between the contacts for reasons of conductivity, while the contact support areas were given a thin layer as a solder substrate. For the composite iron-copper blank, a pressure of 200 MN $m^{-2}$ was chosen for pressing, compared to 500 to 600 MN $m^{-2}$ otherwise customary for iron, in order to prevent premature smearing of the tools by the copper powder. The molding die was sprayed from time to time with a lubricant. Because of the height differences in the central region of the contact bridge, a molded part, i.e., bridge, of different density was obtained, which, however, turned out to be an advantage in extruding. The sintering was carried out either in re-purified nitrogen as the protective gas at 1000° C. or in generator gas as the protective gas. Since the porosity obtained after the first sintering operation, about 30%, was still too high for extrusion deformation, the sizing was performed at a pressure of 800 MN $m^{-2}$ and another subsequent sintering operation performed under the same conditions. In addition to producing a strength-increasing sintering effect at the pores, which were compressed in the sizing, the second heat treatment also self-anneals the material for the subsequent extrusion step. These steps produced a porosity of 1.5 to 2% in the contact area and of about 8% in the central area due to the greater thickness of the material there. During extruding, the contact bridge was lubricated with grease.

The thin copper overlay has an advantageous effect during deformation. Since copper can be deformed more easily than iron, it fills out the region into which iron does not flow because of its excessively high deformation strength and insufficient thickness of the bottom. As a result, a contact bridge is obtained which has sharp corners but no burr in the region of the soldering areas, which is particularly advantageous for the soldering of the contact overlay.

The porosity differences in the contact region and the central region, resulting from the pressing operation after the sizing, aid in the deformation of the contact bridge into the desired form. In the compact material, the material flows from the start heavily from the central region into the thin longitudinal rims, which thereby flow outwardly with increased height. In the sintered part, however, the iron is predominantly densified first in the central region of the contact bridge because of the higher porosity there, while it already flows out into the end face rims at the ends of the bridge. This explains the equally good filling of the end and lengthwise rims in the case of the sintered part.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A method of manufacturing a contact bridge for an electric switching apparatus, said contact bridge including an electrically highly conductive copper overlay and a concave-shaped iron support layer, comprising the steps of sequentially pressing a powder blank at a pressure of between about (200 and 400)$\times 10^6$ Newton/$m^2$ comprising two layers of metallic material, one of said layers comprising predominantly of iron and one of said layers comprising predominantly of copper, said iron layer comprising said support layer and said copper layer comprising said overlay;

sintering said blank in a protective gas at a temperature of about 1000° C.;

sizing said blank at a pressure of between about (600 and 1000)$\times 10^6$ Newton/$m^2$;

further sintering said blank in a protective gas;

further pressing said blank by reverse-flow cup extrusion; and thereafter applying an electrical contact to said overlay.

2. The method recited in claim 1, wherein said step of pressing comprises pressing said blank at a pressure of about $200\times 10^6$ Newton/$m^2$, wherein said step of sizing comprises sizing said blank at a pressure of about $800\times 10^6$ Newton/$m^2$, and wherein said step of further pressing comprises further pressing said blank by reverse-flow cup extrusion at a pressure of about $2000\times 10^6$ Newton/$m^2$.

* * * * *